US006422895B1

(12) United States Patent
Lien

(10) Patent No.: US 6,422,895 B1
(45) Date of Patent: Jul. 23, 2002

(54) RECEPTACLE FOR TELEPHONE PLUG AND WIDE-BAND CABLE PLUG

(75) Inventor: Mei-Chia Lien, Taipei Hsien (TW)

(73) Assignee: M M E Corporation, Taipei Hsien (TW)

( * ) Notice: Subject to any disclaimer, the term of this patent is extended or adjusted under 35 U.S.C. 154(b) by 0 days.

(21) Appl. No.: 09/835,367

(22) Filed: Apr. 17, 2001

(51) Int. Cl.[7] ..... H01R 3/00; H01R 29/00
(52) U.S. Cl. ..... 439/489; 439/188
(58) Field of Search ..... 439/488, 489, 439/660, 668, 669, 676, 638, 639, 188

(56) References Cited

U.S. PATENT DOCUMENTS 5,613,872 A * 3/1997 Fukuda et al. ..... 439/489
5,638,944 A * 6/1997 Diebel et al. ..... 200/43.03
5,775,936 A * 7/1998 Tsuji ..... 439/489
5,800,192 A * 9/1998 David et al. ..... 439/188
6,027,365 A * 2/2000 Kaufman ..... 439/489
6,045,049 A * 4/2000 Nishimura et al. ..... 235/486
6,045,395 A * 4/2000 Saito et al. ..... 439/489
6,135,809 A * 10/2000 Asakawa ..... 439/489
6,220,899 B1 * 4/2001 Suzuki ..... 439/675

* cited by examiner

*Primary Examiner*—P. Austin Bradley
*Assistant Examiner*—Edwin A. Leön
(74) *Attorney, Agent, or Firm*—Bacon & Thomas

(57) ABSTRACT

A receptacle for receiving telephone plug and wide-band cable plug includes a body with a terminal having at least 8 pins connected to the body and an inlet defined in the body. A first recess and a second recess are respectively defined in the body so as to respectively receive a first checking member and a second checking member. The first checking member has a first contact portion and the second checking member has a second contact portion which extends in the inlet so that when a smaller telephone line plug is inserted in the inlet, the second contact portion is not pushed, and the second contact portion is pushed to contact the first contact portion when a lager wide-band cable plug is inserted in the inlet.

7 Claims, 5 Drawing Sheets

RECEPTACLE FOR TELEPHONE PLUG AND WIDE-BAND CABLE PLUG

FIELD OF THE INVENTION

The present invention relates to a receptacle having two checking members which are not affected when a telephone plug is inserted in the receptacle, but are affected when a wide-band cable plug is inserted in the receptacle.

BACKGROUND OF THE INVENTION

A conventional receptacle for connecting a telephone line is equipped with 2 to 6 pins for connecting the telephone plug, which also has 2 to 6 lines. The telephone line can only transmit audio messages. A wide-band frequency cable is developed to transmit audio messages, video messages and digital signals so that it requires an 8-pin chip to achieve full utilization of the cable. The plug on the wide-band cable cannot be used with the telephone line receptacle because the wide-band cable plug is bigger and requires 8 pins. There are two separate jacks for respectively receiving the telephone line and the wide-band cable in a computer so that the users may choose either of the two types of signal lines to use. However, the occupies a large space which is not allowed in modem computers.

The present invention is intended to provide a receptacle that has one inlet which receives either of the telephone line plug or the wide-band cable plug, and two checking members which will be activated when the larger wide-band cable plug is inserted in the inlet of the receptacle.

SUMMARY OF THE INVENTION

In accordance with one aspect of the present invention, there is provided a receptacle for receiving the telephone plug and a wide-band cable plug. The receptacle comprises a body with a terminal having at least 8 pins connected to the body, and an inlet defined in the body. A first recess and a second recess are respectively defined in the body, and a first checking member and a second checking member are respectively inserted into the two recesses. The first checking member has a first contact portion which is pushed to contact a second contact portion of the second checking member when a larger wide-band cable plug is inserted in the inlet.

The primary object of the present invention is to provide a receptacle that can receive either the telephone line plug or the wide-band cable plug.

The present invention will become more obvious from the following description when taken in connection with the accompanying drawings which show, for purposes of illustration only, two preferred embodiments in accordance with the present invention.

DETAILED DESCRIPTION OF THE INVENTION

Figure 1:
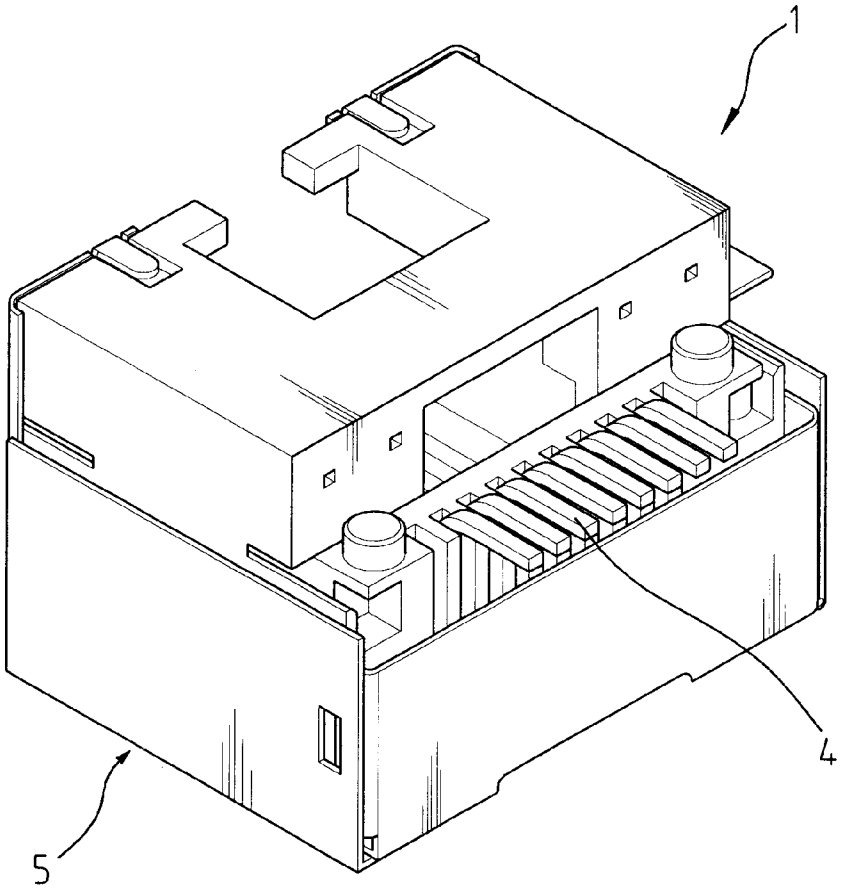
FIG. 1 is a perspective view to show the receptacle of the present invention.
Figure 2:
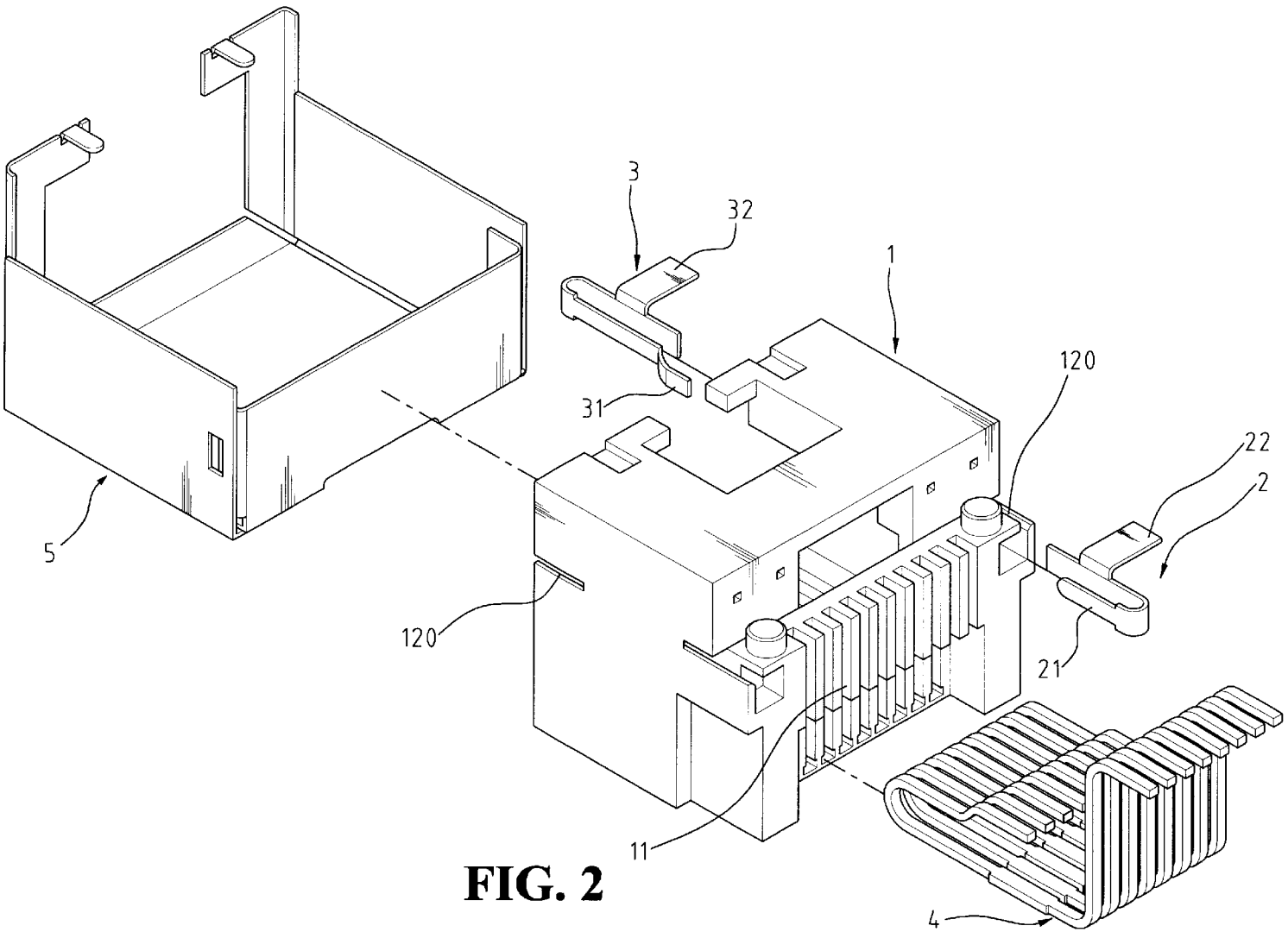
FIG. 2 is an exploded view to show the receptacle of the present invention.
Figure 3:
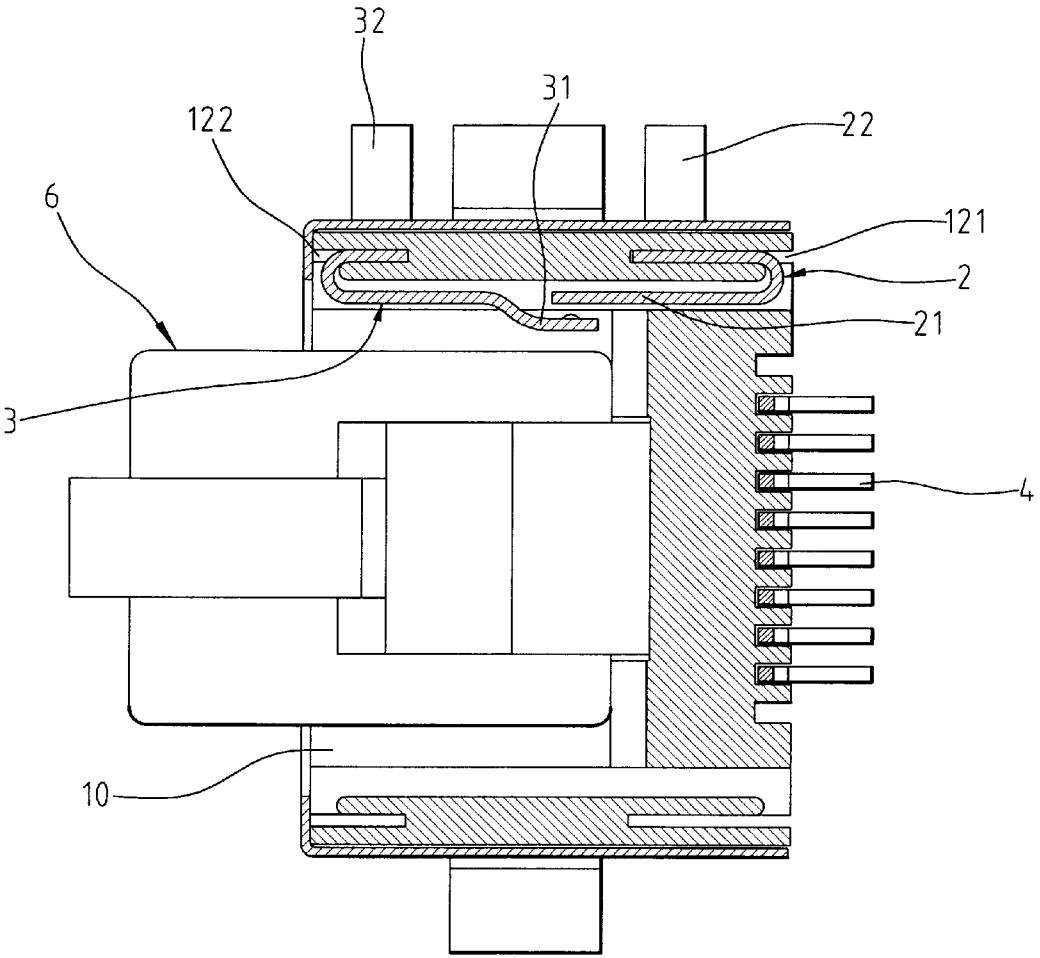
FIG. 3 is a cross sectional view to show that two checking members do not contact when a smaller telephone line plug is inserted into the receptacle.

Referring to FIGS. 1 and 3, the receptacle for receiving a telephone plug and a wide-band cable plug according to the present invention comprises a body 1 and a plurality of grooves 11 defined in a first end of the body 1 so as to receive a terminal 4 having at least 8 pins connected to the body 1. A cover 5 is connected to the body 1 so as to partially cover the pins and an inlet 10 is defined in a second end of the body 1. A first recess 121 and a second recess 122 are respectively defined in the body 1 and two slots 120 are defined in the body 1 and respectively communicate with the first recess 121 and the second recess 122. Each of the first recess 121 and the second recess 122 has an island located therein.

A U-shaped first checking member 2 is inserted in the first recess 121 and engaged with the island. The first checking member 2 has a first contact portion 21 and a first connection plate 22 which extends through the slot 120. A second checking member 3 is inserted in the second recess 122 and engaged with the island. The second checking member 3 has a second contact portion 31 and a second connection plate 32 which extends through the slot 120. A circuit board (not shown) is connected to the two connection plates 22, 32. The second contact portion 31 extends in the inlet 10 and a gap is defined between the first contact portion 21 and the second contact portion 31 as shown in FIG. 3. When a smaller telephone line plug 6 is inserted in the inlet 10, the second contact portion 31 is not pushed by the smaller telephone line plug 6, so that the gap between the first contact portion 21 and the second contact portion 31 still exists. The telephone line plug 6 will be in contact with pins #2 to #6 as expected.

Figure 4:
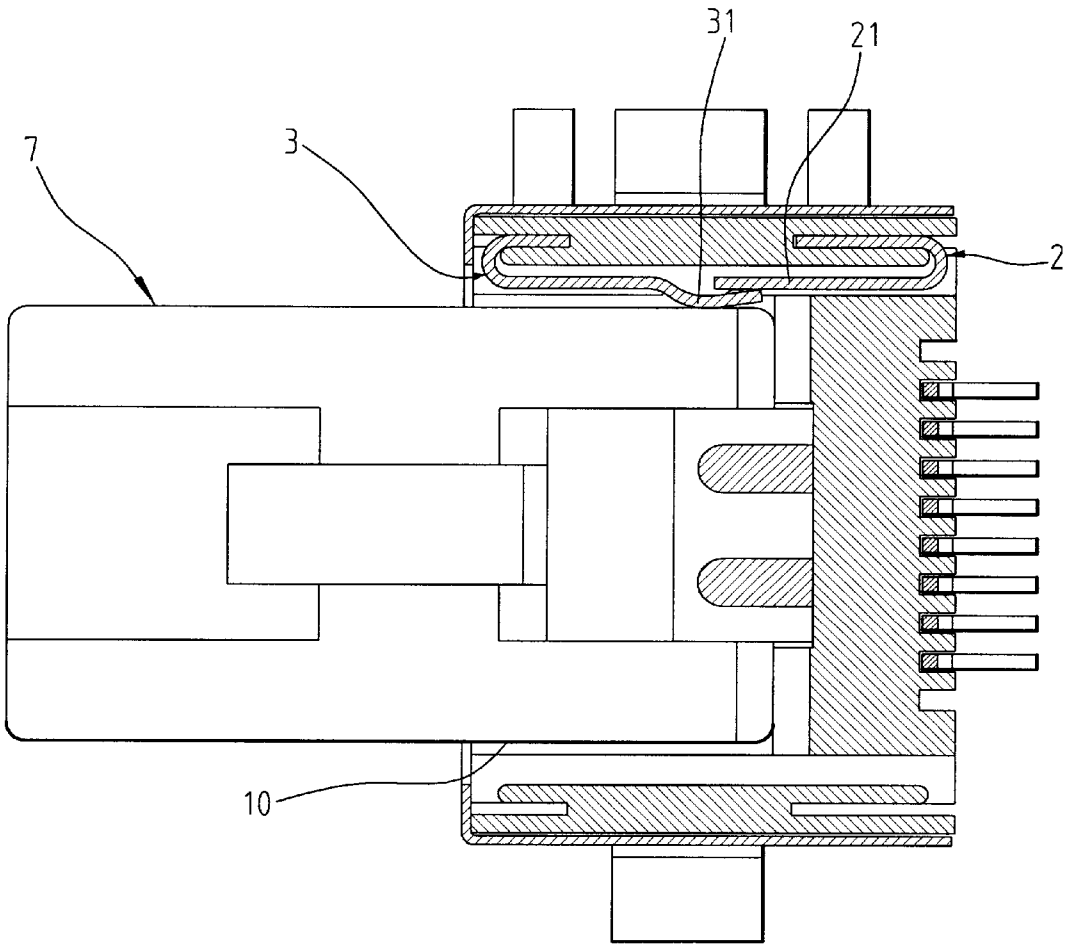
FIG. 4 is a cross sectional view to show that two checking members contact when a larger wide-band cable plug is inserted into the receptacle.

Referring to FIG. 4, when a larger wide-band cable plug 7 is inserted into the inlet 10, a side of the wide-band cable plug 7 pushes the second contact portion 31 to contact the first contact portion 21 so as to activate a certain circuit and the plug 7 contacts the pins #1 to #8.

Figure 5:
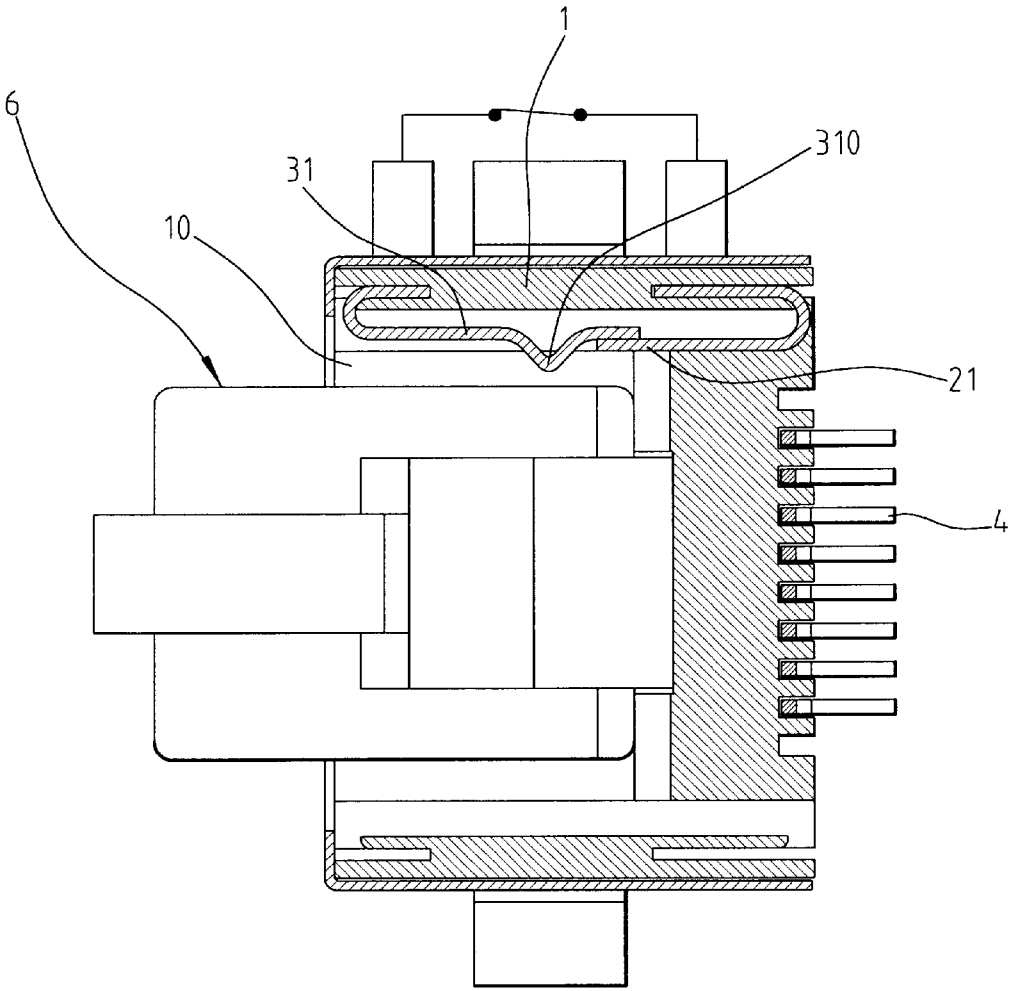
FIG. 5 is a cross sectional view to show another embodiment of the two checking members which are normally contact with each other.

FIG. 5 shows an alternative embodiment in which the first contact portion 21 and the second contact portion 31 are normally closed as shown. The second contact portion 31 has a protrusion 310 which is formed by bending the second contact portion 31 so that a distal end of the second contact portion 31 is located on the first contact portion 21. The protrusion 310 extends in the inlet 10 so that when a smaller telephone line plug 6 is inserted in the inlet 10, the protrusion 310 is not pushed by the smaller telephone lien plug 6, so that the first contact portion 21 is still in contact with the second contact portion 31. When a larger wide-band cable plug is inserted into the inlet 10, a side of the wide-band cable plug 7 will push the protrusion 310 so as to separate contact portion 31 from the first contact portion 21 and activate a certain circuit.

While we have shown and described various embodiments in accordance with the present invention, it should be clear to those skilled in the art that further embodiments may be made without departing from the scope of the present invention.

What is claimed is:

1. A receptacle for receiving a telephone plug and a wide-band cable plug, comprising:

a body and a terminal having at least 8 pins connected to said body, an inlet defined in said body, a first recess defined in said body, and a second recess also defined in said body, wherein said inlet is arranged to receive both said telephone plug and said wide-band cable plug, and a first checking member inserted in said first recess and having a first contact portion, a second checking member inserted in said second recess and having a second contact portion, said second contact portion extending in said inlet and a gap defined between said first contact portion and said second contact portion, wherein said recesses and checking members are positioned such that when said wide-band cable plug is inserted into said inlet, said wide-band cable plug engages and pushes said second contact portion, causing said second contact portion to contact said first contact portion, and wherein when said telephone plug is inserted into said inlet, said telephone plug fails to engage said second contact portion, said second contact portion is not pushed by said telephone plug, and said second contact portion fails to contact said first contact portion, thereby enabling the telephone plug to be distinguished from the wide-band cable plug based on whether said first and second contact portions contact each other.

2. The receptacle as claimed in claim 1, wherein each of said first checking member and said second checking member is a U-shaped member, each of said first recess and said second recess having an island located therein so that said first checking member and said second checking member are respectively engaged on said two respective islands.

3. The receptacle as claimed in claim 1, further comprising two slots defined in said body and respectively communicating with said first recess and said second recess, each of said first checking member and said second checking member having a connection plate extending through a respective one of said two slots.

4. A receptacle for receiving a telephone plug and a wide-band cable plug, comprising:

a body and a terminal having at least 8 pins connected to said body, an inlet defined in said body, a first recess defined in said body, and a second recess also defined in said body, wherein said inlet is arranged to receive both said telephone plug and said wide-band cable plug, and a first checking member inserted in said first recess and having a first contact portion, a second checking member inserted in said second recess and having a second contact portion, said second contact portion extending in said inlet and contacting said first contact portion, wherein said recesses and checking members are positioned such that when said wide-band cable plug is inserted into said inlet, said wide-band cable plug engages and pushes said second contact portion away from said first contact portion, and wherein when said telephone plug is inserted into said inlet, said telephone plug fails to engage said second contact portion and said second contact portion is not pushed away from said first contact portion by said telephone plug, thereby enabling the telephone plug to be distinguished from the wide-band cable plug based on whether said first and second contact portions contact each other.

5. The receptacle as claimed in claim 4, wherein each of said first checking member and said second checking member is a U-shaped member, each of said first recess and said second recess having an island located therein so that said first checking member and said second checking member are respectively engaged on said two respective islands.

6. The receptacle as claimed in claim 4, further comprising a protrusion extending from said first contact portion and into said inlet.

7. The receptacle as claimed in claim 4, further comprising two slots defined in said body and respectively communicating with said first recess and said second recess, each of said first checking member and said second checking member having a connection plate extending through a respective one of said two slots.

* * * * *